US007431036B2

(12) United States Patent
Al-Bannai

(10) Patent No.: US 7,431,036 B2
(45) Date of Patent: Oct. 7, 2008

(54) LOVE MAKING APPARATUS FOR THE DISABLED

(76) Inventor: Abdulrahman Al-Bannai, P.O. Box 240, Salmiya 22003 (KW)

( * ) Notice: Subject to any disclaimer, the term of this patent is extended or adjusted under 35 U.S.C. 154(b) by 171 days.

(21) Appl. No.: 11/459,476

(22) Filed: Jul. 24, 2006

(65) Prior Publication Data

US 2008/0023008 A1 Jan. 31, 2008

(51) Int. Cl.
*A61G 15/00* (2006.01)

(52) U.S. Cl. ..... 128/845; 5/602

(58) Field of Classification Search ..... 128/845; 108/126, 17, 115, 125, 129; 5/602, 603, 5/601; 211/186, 187, 134
See application file for complete search history.

(56) References Cited

U.S. PATENT DOCUMENTS 7,018,329 B2 * 3/2006 Yu ..... 600/38
2006/0168727 A1 * 8/2006 Heimbrock ..... 5/602
2007/0209559 A1 * 9/2007 Mockel ..... 108/115

* cited by examiner

*Primary Examiner*—Terrell McKinnon
*Assistant Examiner*—Ophelia Hawthorne
(74) *Attorney, Agent, or Firm*—Lowe Hauptman Ham & Berner, LLP

(57) ABSTRACT

A love making apparatus for the disabled includes a horizontal support member and a pair of generally horizontal coplanar platforms disposed on the support member with one of the platforms reciprocally moveable with respect to the other along a longitudinal axis. One of the platforms which are stationary includes a foldable backrest while the moveable platform includes a pair of foldable leg supports and a pair of foldable handgrips for providing reciprocal movement. A pair of seatbelts is provided to protect the individuals from falling off of the device. The apparatus also includes a longitudinally extending rod or frame member and two leg members rotatable about the frame member. The two leg members and two rectangular shaped support elements position the platform above a floor.

12 Claims, 7 Drawing Sheets

LOVE MAKING APPARATUS FOR THE DISABLED

FIELD OF THE INVENTION

This invention relates a love making apparatus for the disabled and more particularly to an apparatus for assisting a disabled individual to have marital relations with a consenting adult.

BACKGROUND FOR THE INVENTION

Apparatus for enhancing sexual intimacy and performance of the marital act are known. Similar devices are also known for use by disabled individuals and as an aid for those who may have difficulty in having intercourse. For some individuals, it may be painful to assume a position or provide the necessary support and movement for marital relations. For example, male paraplegics, men with back and spinal problems, infirm persons, obese persons and others may need an apparatus for facilitating sexual relations.

A U.S. Pat. No. 5,453,080 of Mitchum Jr. discloses Intercourse-Facilitating Therapeutic Furniture for Disabled Persons. The furniture is adapted to support a man and woman partners engaged in intercourse and have a longitudinally moveable man's seat facing an adjustable-position female seat. The male partner is supported by a seat with his back in a substantially upright position to relieve stress on lumbar vertebrae, pelvis and legs. Longitudinal movement of the man's seat is effected by hand operation of a joy stick and mechanical communication with a seat or by actuation of an electric motor in electrical communication with a man's seat. The woman's seat is independently adjustable.

A more recent U.S. Pat. No. 6,689,029 of Wakeman discloses a Medical Aid and Apparatus for Enhancing Sexual Intimacy. As disclosed therein the apparatus includes a pair of main tubular support members, each including first, second and third extents. The first extent is operationally coupled to a proximal end of the second extent, and the third extent is operationally coupled to a distal end of the second extent. The main tubular members are positioned in a spaced parallel relationship and provide vertical support for the apparatus. A main platform member is operationally coupled to the pair of main tubular members. The main platform member includes a first surface, and is positioned such that the first platform surface is substantially above a surface of the second extent of the main tubular member. The main platform is designed for supporting a first user.

A further example of prior art devices for sexual stimulation, enrichment or gratification is disclosed in a U.S. Pat. No. 6,926,006 of Black for a Bench With a Swinging Seat. As disclosed, a bench with a swinging seat has straps for securing the wrists and padded support for the legs. The seat swings back and forth under control of the arms, legs or other moving parts of the body of the user. A bracket fastened to the rear end of the bench supports a device for vaginal or anal manipulation as the seat swings back and forth.

Notwithstanding the above, it is presently believed that there is a need and a potential commercial market for an improved love making apparatus in accordance with the present invention. There should be a demand for such apparatus because the apparatus facilitates marital relations for the disabled. The apparatus includes a sliding bed with a short fixed seat for a man to sit on and a sliding moveable larger portion for a woman to lie on. Advantageously, both seats include belts to prevent the individuals from falling off the apparatus. The motion is then provided by the male using his hands to reciprocate the sliding portion of the apparatus. Padded leg supports for the woman are provided. Further, the apparatus in accordance with the present invention is secure and safe during usage, is light weight and easy to use and most of the major parts of the apparatus are foldable to become one long generally flat bed-like structure that can be conveniently stored. Finally, it is believed that the apparatus can be produced and sold at a competitive price.

BRIEF SUMMARY OF THE INVENTION

In essence, the present invention contemplates a love making apparatus for the disabled that includes a generally horizontal support member having first and second ends along a longitudinal axis and a pair of generally horizontal parallel rails disposed on the support member. The rails extend from near one end of the support member toward the second end thereof, but end between about half way to about three-quarters of the way to the opposite end. The apparatus also includes a pair of co-planar platforms, one of which is stationary and the other moveable on the support member. The stationary platform is fixed at one end of the support member beyond the end of the parallel rails which extend from the other end while the moveable platform is adapted to move on the rails along the longitudinal axis toward and away from the stationary platform. A pair of seat belts is provided with one of said seat belts for the stationary platform and the other for the moveable platform to prevent individuals from falling off of the apparatus. The apparatus also includes a pair of hand grips fixed to the moveable platform at one end thereof nearest to the stationary platform for an individual on the stationary platform to grip and move the moveable platform along the longitudinal axis. In a preferred embodiment of the invention, the stationary platform includes an adjustable backrest for positioning an individual in a seated position with the upper body in at least a partially upright position and preferably in an upright position. The adjustable backrest is also foldable into a position which is parallel with the platform and adjacent thereto for storage. In the preferred embodiment of the invention the seat belt for the stationary platform extends around the upper body from the seat back.

The invention will now be described in connection with the accompanying drawings wherein like numerals have been used to identify like elements.

DESCRIPTION OF THE PREFERRED EMBODIMENTS OF THE INVENTION

Figure 1:
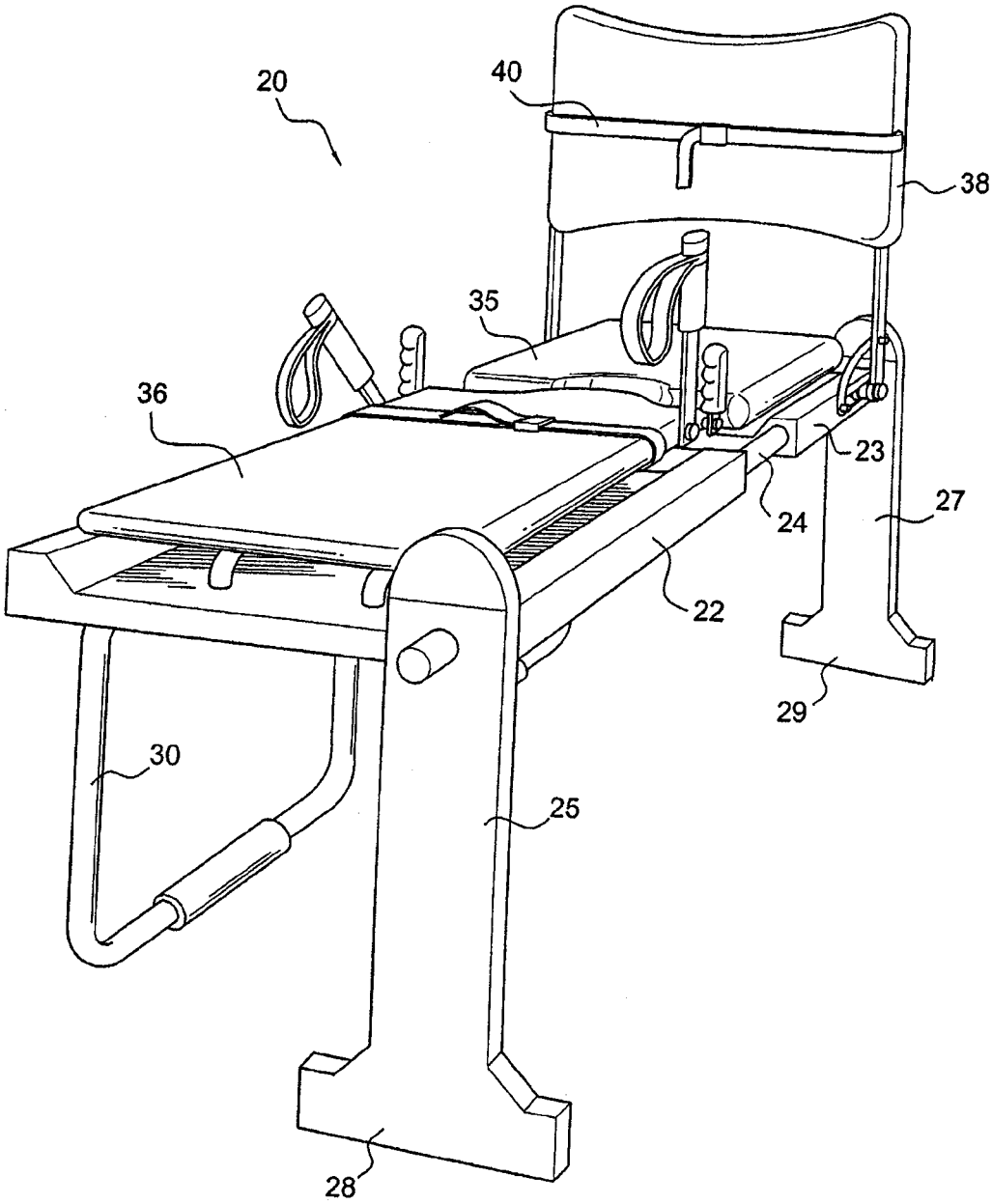
FIG. 1 is a perspective view of a love making apparatus in accordance with the present invention.
Figure 2:
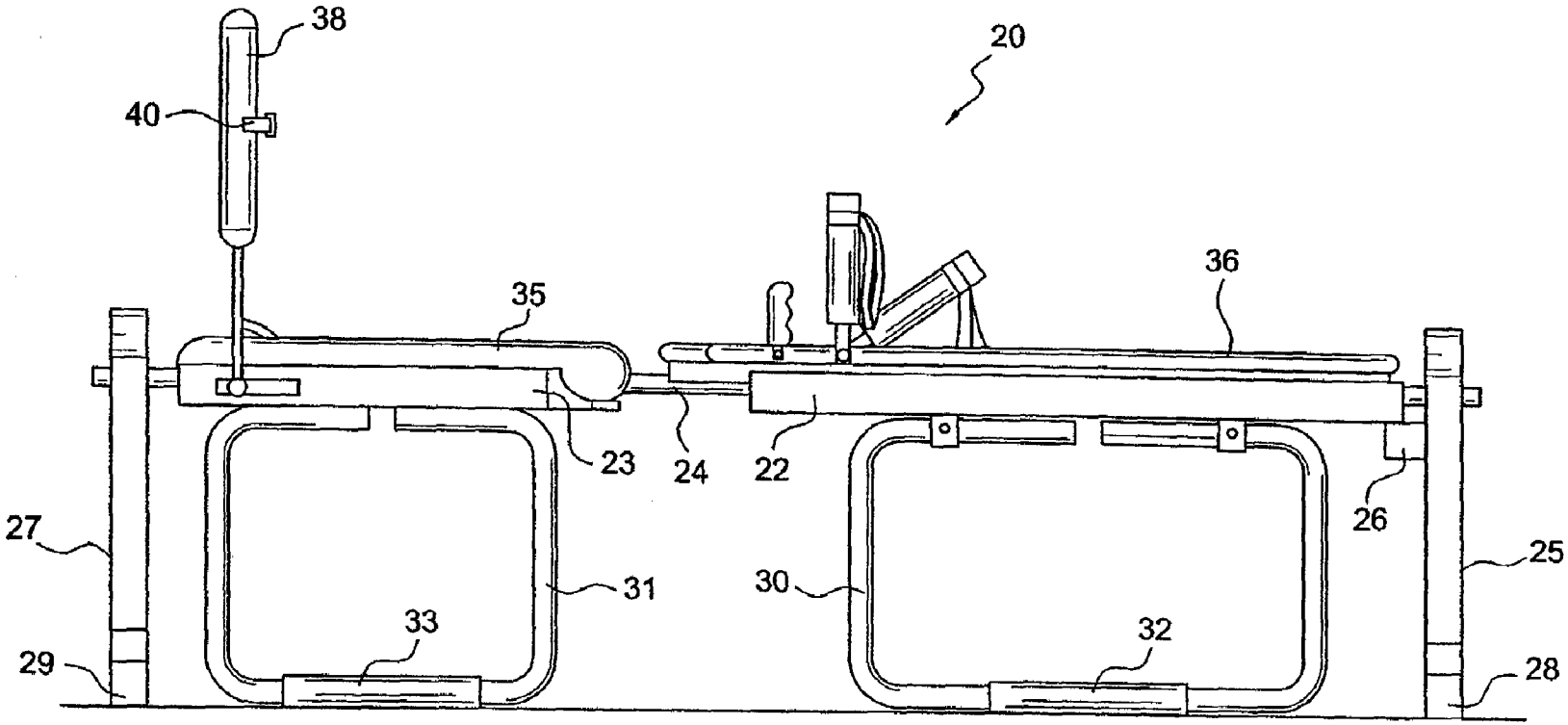
FIG. 2 is a side elevational view of the love making apparatus shown in FIG. 1.

A love making apparatus 20 for use by a handicapped individual will now be described with respect to the following FIGS. 1-7. The overall apparatus 20 as shown more clearly in FIGS. 1 and 2, and includes a support member 22 which may include a second or separate support member 23 as shown. The two support members are connected by a structural rod 24. The rod 24 extends along the length of the apparatus along one side thereof between two major leg members 25 and 27. The leg members 25 and 27 are rotatably mounted on the ends of the rod 24. Locking means such as a locking pin assembly 26 and 26' (FIG. 2) locks the leg members 25 and 27 in a vertical position.

The leg members 25 and 27 have sufficient size and mass to provide structural strength and rigidity to the apparatus and may be rotated through about 90° after release of the locking pin assemblies 26 and 26' to about 90°. The leg members 25 and 27 are rotatable between a vertical position for supporting the support member 22 members in a horizontal position for storage. The leg members 25 and 27 each include a T-shaped base 28 and 29 respectfully, that have a width of about 20 cm and a thickness of about 6 cm. These members may be hollow but provide a sufficient footprint for stability.

As illustrated the apparatus 20 also includes a pair of rectangular shaped support elements 30 and 31 that are rotatably mounted to the support members 22 and 23 respectfully on the side which is opposite from the rod 24. The support elements are rotatable through about 90° to a vertical position for supporting the apparatus above the floor during use and a horizontal position for storage. These elements 30 and 31 are preferably made from aluminum tubing and include rubber cylinders 32 and 33 respectfully to avoid slippage on the floor. Similarly a rubber pad may be mounted on the bottom of the T-shaped bases 28 and 29 to prevent slippage. A conventional locking assembly 56 (FIG. 7) may also be used to maintain the elements 30 and 31 in the vertical position for safety.

An important feature in the present invention resides in a pair of co-planar platforms including a stationary platform 35 for supporting a male in a seated position at one end of the apparatus and a moveable platform 36 for supporting a female in a prone position with the male facing the female. A foldable seat back 38 is provided for supporting the male in a generally upright seated position and includes a safety belt for strapping the upper portion of the male's body to the back of the seat. The foldable seat back 38 and adjustment for the seat back is shown more clearly in FIGS. 3 and 4. As illustrated, in FIG. 4, the seat back 38 is pivotally mounded by means of a locking pin 42 disposed in a slot 43. The locking pin 42 may be moved longitudinally in the slot 43 for positioning the seat back for the comfort of the user. One end of an arc shaped adjustment support member 45 is pivotally fixed to one side of the support member 23. The opposite end is connected by a slide bolt 46 that rides in a slot 47 in an upright portion of the seat back 38.

Figure 3:
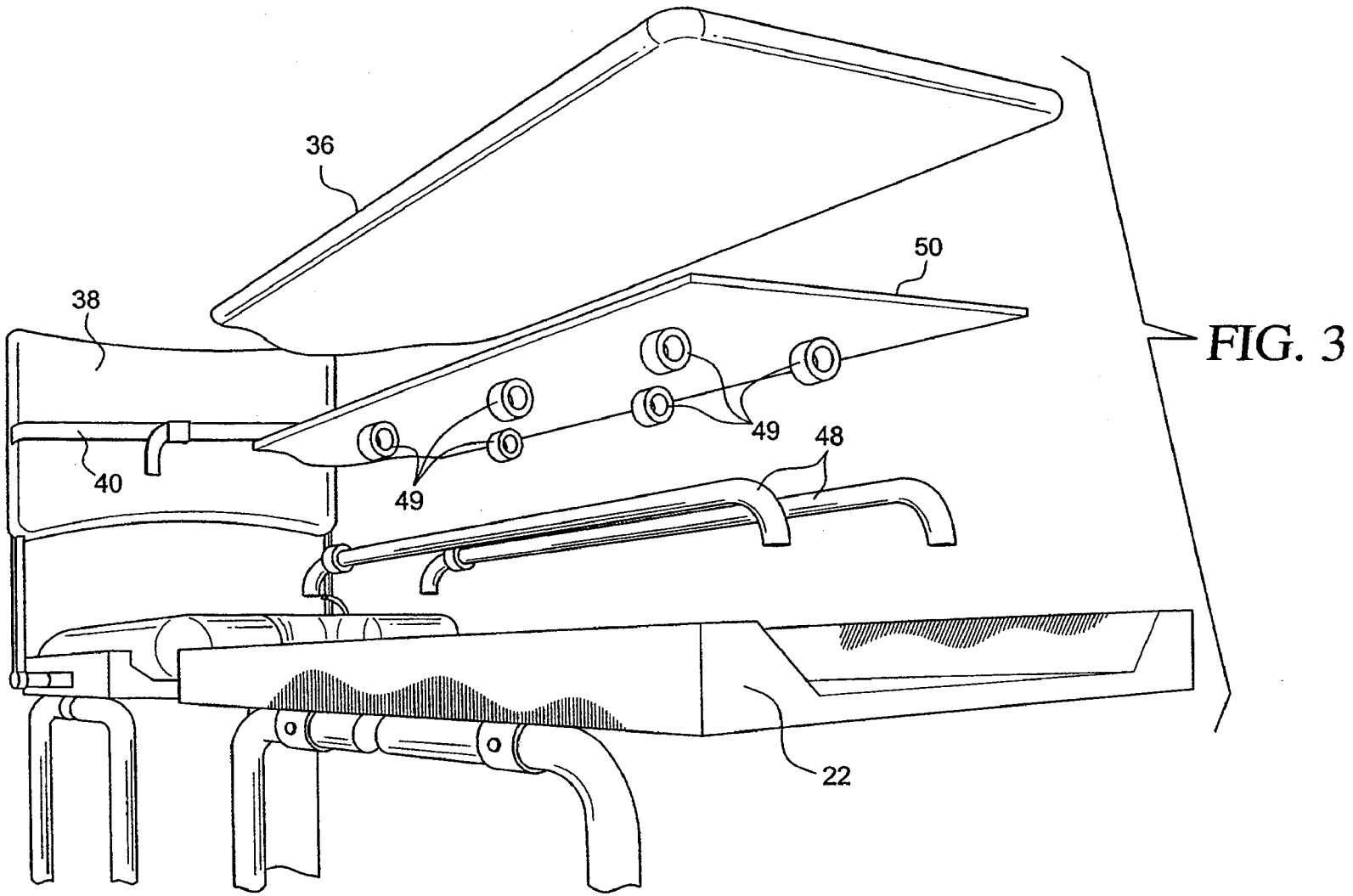
FIG. 3 is a perspective view partially exploded of the love making apparatus shown in FIGS. 1 and 2.
Figure 4:
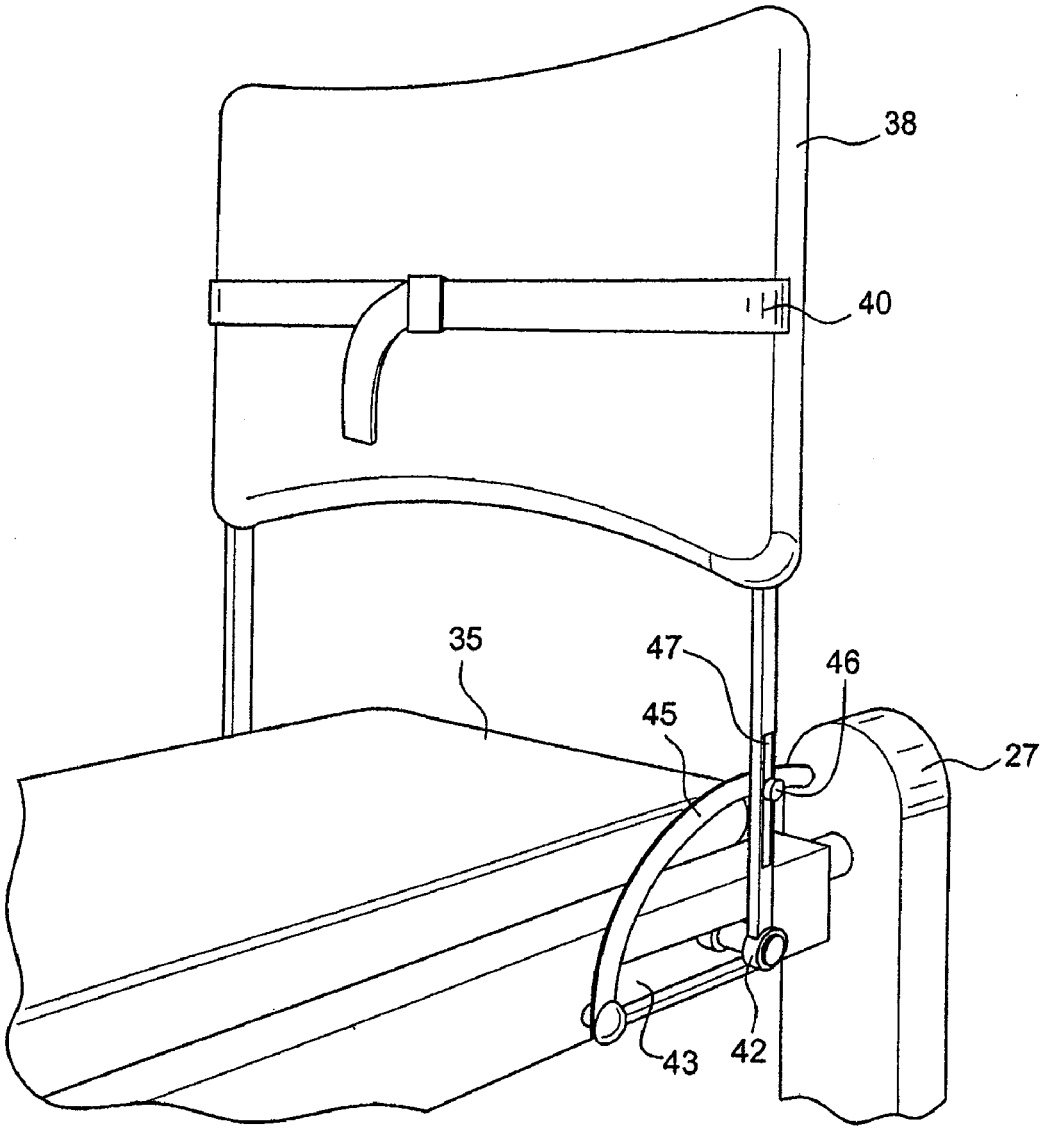
FIG. 4 is a perspective view of a portion of the apparatus shown in FIGS. 1-3.

As illustrated in FIG. 3, a pair of aluminum rails 48 is fixed to the support member 22 in a conventional manner. The rails 48 are preferably made of aluminum tubing. Six sleeve bearings 49 carry an aluminum plate 50 and ride on the rails 48 for allowing the platform 36 to be moved backward and forward along the longitudinal axis. Means for limiting the movement of the platform are provided as for example the turned down ends of the tubes 43 or other suitable stops.

Figure 5:
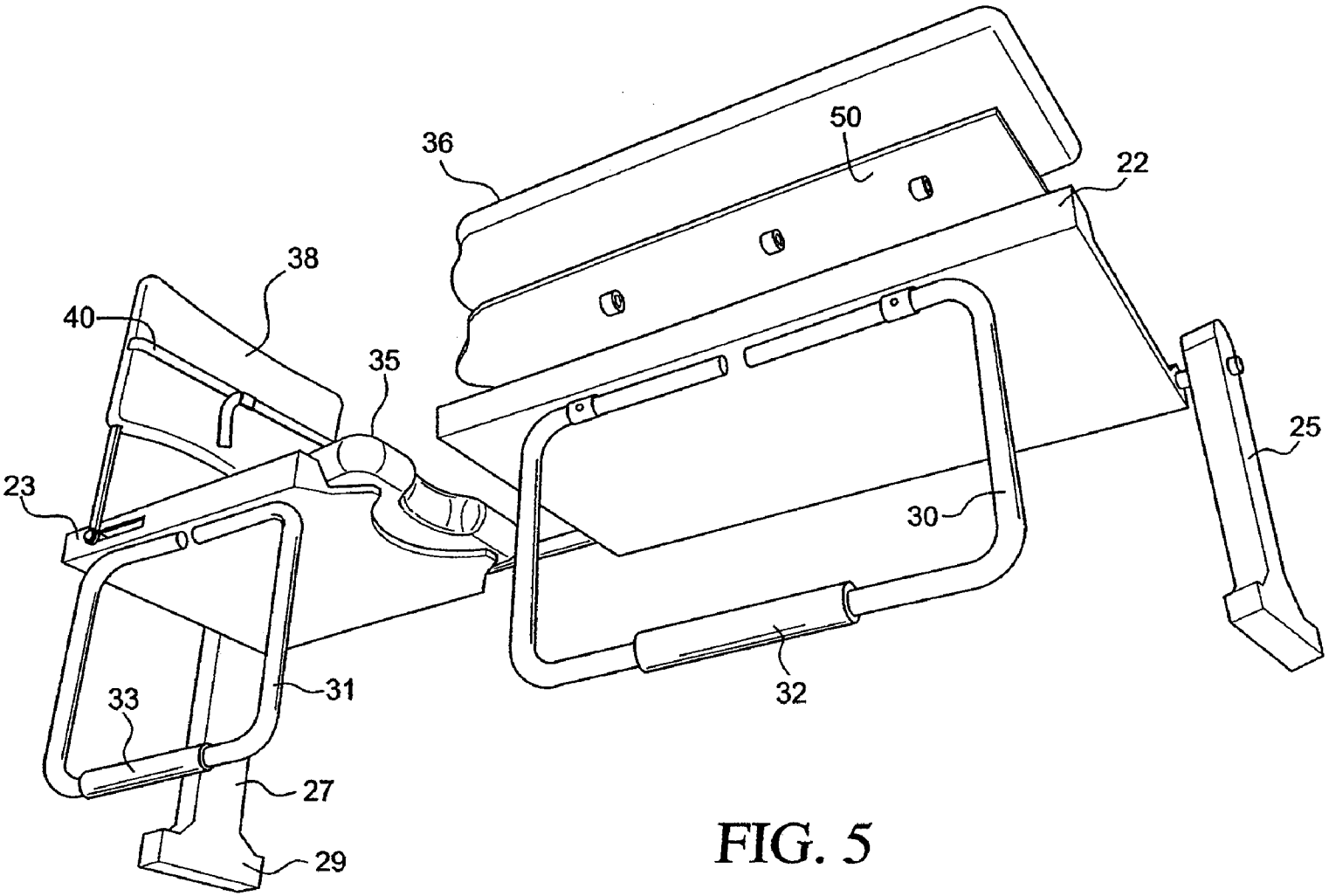
FIG. 5 is a perspective view illustrating the underside of the love making apparatus in accordance with the present invention.
Figure 7:
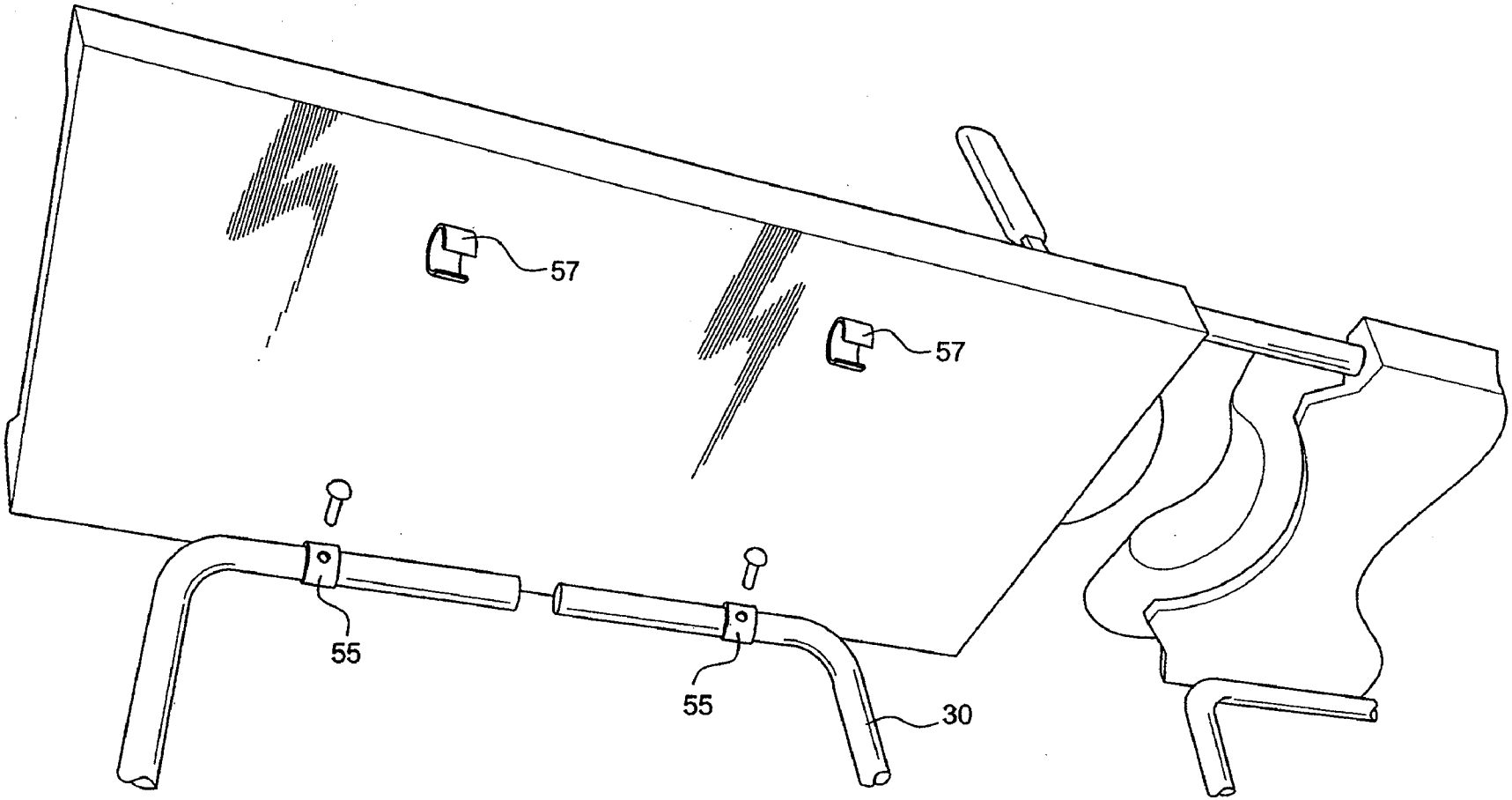
FIG. 7 is a perspective view of a portion of the underside of an apparatus in accordance with one embodiment of the invention.

The underside of the apparatus in accordance with the present invention is shown more clearly in FIG. 5. As shown the T-shaped or rectangular support elements 30 and 31 are disposed along one side of the support member 22. The fastening elements 55 (slide bearing) are of a hard plastic and of conventional design and fixed to the bottom of the support member 22 in a conventional manner. As shown in FIG. 7, a pair of plastic clips 57, also of conventional design are fixed to the bottom of the support member 22 on an opposite side thereof for holding the D-shaped support elements flat against the support member for storage. In addition, means such as a pin and pair of alignment holes 56 may be used to maintain the D-shaped support elements in their vertical position and prevent them from collapsing during use.

Figure 6:
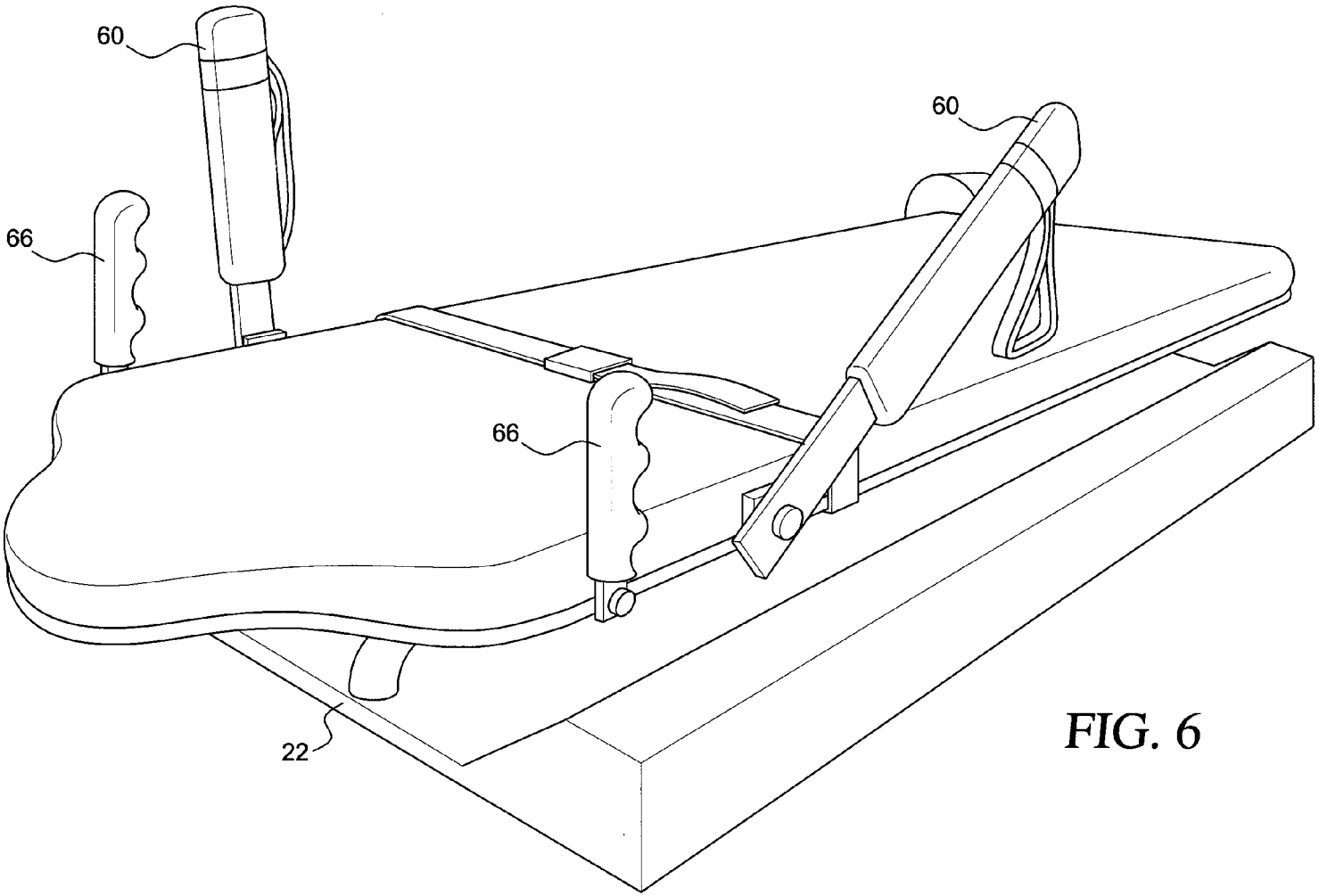
FIG. 6 is a perspective view of an upper portion of the apparatus shown in FIGS. 1-5.

FIG. 6 illustrates the positioning of padded leg supports 60 which are rotatably mounted on the support member 22 with one leg support on each side thereof. As shown, the leg supports are rotatably mounted with a compression bolt 62 in a conventional manner. The compression bolt may be tightened in response to resistance to increase or decrease the resistance to movement in a conventional manner. A stirrup 63 may be attached to each padded leg support 60. In addition, a pair of handgrips 66 with one hand grip on each side of the support member 22 is provided so that the man can pull the moveable platform toward and push the platform away from himself for reciprocal movement.

While the invention has been described in connection with its preferred embodiments it should be recognized that changes and modifications may be made therein without departing from the scope of the appended claims.

What is claimed is:

1. A love making apparatus for the disabled comprising a support member having first and second ends, a pair of generally horizontal rails and a pair of coplanar platforms including a stationary platform and a moveable platform disposed along a longitudinal axis on said support member in a generally horizontal plane with said stationary platform fixed at one end of said support member and said moveable platform being reciprocally moveable on said rails along the longitudinal axis toward and away from said stationary platform, and a pair of seat belts with one of said seat belts attached to said stationary platform and the other of said seat belts attached to said moveable platform for preventing an individual from falling off of the apparatus, and a pair of handgrips fixed to said moveable platform at one end thereof near said stationary platform for an individual on said stationary platform to grip and move said moveable platform along said longitudinal axis, and said stationary platform including an adjustable backrest for positioning an individual in a seated position with the upper body is at least a partially upright position and said adjustable backrest folded forwardly to a position parallel with said platform for storage.

2. A love making apparatus for the disabled according to claim 1 in which said apparatus includes a pair of padded leg supports disposed at one end of said moveable platform nearest said stationary platform and moveable with said moveable platform and each of leg supports being rotatable along one side of said moveable platform into a folded position for storage of the apparatus.

3. A love making apparatus for the disabled according to claim 2 in which said handgrips are rotatably attached to the sides of said moveable platform and rotatable into a generally parallel position with said platform for storage of the device.

4. A love making apparatus for the disabled according to claim 3 in which said seatbelt attached to said stationary platform is fixed to said backrest and adapted to extend around the upper body of an individual seated on the stationary platform.

5. A love making apparatus for the disabled according to claim 3 in which said support member includes a frame and a pair of rotatable leg members rotatably attached to one side of said frame at opposite ends of said frame and rotatable from a perpendicular position for supporting said frame above a floor to a parallel position along the opposite sides of said frame for storage of the apparatus.

6. A love making apparatus for the disabled according to claim 5 in which said rotatable leg members each include a T-shaped foot portion for engaging a floor.

7. A love making apparatus for the disabled according to claim 6 in which said support member includes a frame member and at least one rod shaped element having a circular cross-section along the length of said apparatus between said foldable leg members.

8. A love making apparatus for the disabled according to claim 7 which includes a pair of generally rectangular support elements disposed on an opposite side of said frame from said rotatable support members and said pair of generally rectangular support elements rotatable between a position perpendicular to said frame for supporting said apparatus and a parallel position for storage of the apparatus.

9. A love making apparatus for the disabled according to claim 8 in which each of said generally D-shaped supports have a generally circular cross-section and a non-skid covering for engagement with a floor.

10. A love making apparatus for the disabled according to claim 1 in which said apparatus is foldable into a generally flat package.

11. A love making apparatus for the disabled according to claim 10 in which said rails include stops at one end thereof to prevent said platform from moving beyond said support member.

12. A love making apparatus for the disabled according to claim 10 in which said rails are tubular with a circular cross-section and circular bearings for support.

* * * * *